US005864813A

United States Patent [19]

Case

[11] Patent Number: 5,864,813

[45] Date of Patent: Jan. 26, 1999

[54] METHOD, SYSTEM AND PRODUCT FOR HARMONIC ENHANCEMENT OF ENCODED AUDIO SIGNALS

[75] Inventor: Eliot M. Case, Denver, Colo.

[73] Assignees: U S West, Inc., Denver; MediaOne Group, Inc., Englewood, both of Colo.

[21] Appl. No.: 771,512

[22] Filed: Dec. 20, 1996

[51] Int. Cl.[6] ..... G10L 3/02

[52] U.S. Cl. ..... 704/500; 704/278

[58] Field of Search ..... 704/208, 278, 704/233, 500, 501, 503, 504; 381/62, 119, 118

[56] References Cited

U.S. PATENT DOCUMENTS

| | | |
|---|---|---|
| 4,061,875 | 12/1977 | Freifeld et al. . |
| 4,099,035 | 7/1978 | Yanick . |
| 4,118,604 | 10/1978 | Yanick . |
| 4,156,116 | 5/1979 | Yanick . |
| 4,509,186 | 4/1985 | Omura et al. . |
| 4,536,886 | 8/1985 | Papamichalis et al. . |
| 4,703,480 | 10/1987 | Westall et al. . |
| 4,813,076 | 3/1989 | Miller . |
| 4,820,059 | 4/1989 | Miller et al. . |
| 4,969,192 | 11/1990 | Chen et al. . |
| 4,975,958 | 12/1990 | Hanada et al. . |
| 5,033,090 | 7/1991 | Weinrich . |
| 5,040,217 | 8/1991 | Brandenburg et al. . |
| 5,140,638 | 8/1992 | Moulsley et al. . |
| 5,199,076 | 3/1993 | Taniguchi et al. . |
| 5,201,006 | 4/1993 | Weinrich . |
| 5,226,085 | 7/1993 | Di Francesco . |
| 5,227,788 | 7/1993 | Johnston et al. . |
| 5,233,660 | 8/1993 | Chen . |
| 5,235,669 | 8/1993 | Ordentlich et al. . |
| 5,255,343 | 10/1993 | Su . |
| 5,285,498 | 2/1994 | Johnston . |
| 5,293,449 | 3/1994 | Tzeng . |
| 5,293,633 | 3/1994 | Robbins . |
| 5,301,019 | 4/1994 | Citta . |
| 5,301,205 | 4/1994 | Tsutsui et al. . |
| 5,329,613 | 7/1994 | Brase et al. . |
| 5,341,457 | 8/1994 | Hall, II et al. . |
| 5,353,375 | 10/1994 | Goto et al. . |

(List continued on next page.)

FOREIGN PATENT DOCUMENTS

| | | |
|---|---|---|
| 0446037A2 | 9/1991 | European Pat. Off. . |
| 0446037A3 | 9/1991 | European Pat. Off. . |
| 0607989A2 | 7/1994 | European Pat. Off. . |
| 0607989A3 | 7/1994 | European Pat. Off. . |
| 4369989 | of 1992 | Japan . |
| WO91/06945 | 5/1991 | WIPO . |
| WO94/25959 | 11/1994 | WIPO . |

OTHER PUBLICATIONS

Holtz, The Evolution of Lossless Data Compression Techniques, Sep. 30, 1993.

New Digital Hearing Aids Perk Up Investors' Ears, St. Louis Post–Dispatch, Sep. 27, 1995.

Jean–Pierre Renard, Ph.D., B.B.A., High Fidelity Audio Coding, pp. 87–97.

*Primary Examiner*—David R. Hudspeth
*Assistant Examiner*—Harold Zintel
*Attorney, Agent, or Firm*—Brooks & Kushman

[57] ABSTRACT

A method, system and product are provided for harmonic enhancement of an encoded audio signal. The method includes receiving the encoded audio signal, the encoded audio signal having multiple frequency subbands, selecting one of the subbands having a data sample associated therewith, and generating a frequency doubled copy the data sample associated with the subband. The method also includes generating a new data sample for a second subband using the frequency doubled copied data sample, the second subband having a frequency greater than the first subband by one octave, and modifying the encoded audio signal to create an enhanced encoded audio signal having the new data sample associated with the second subband. The system includes control logic for performing the method. The product includes a storage medium having computer readable programmed instructions for performing the method.

15 Claims, 2 Drawing Sheets

U.S. PATENT DOCUMENTS 5,361,306 11/1994 Garcia ..... 381/98
5,404,377 4/1995 Moses .
5,467,139 11/1995 Lankford .
5,473,631 12/1995 Moses .
5,488,665 1/1996 Johnston et al. .
5,500,673 3/1996 Zhou .
5,509,017 4/1996 Brandenburg et al. .
5,511,093 4/1996 Edler et al. .
5,512,939 4/1996 Zhou .
5,515,395 5/1996 Tsutsui .

Fig. 3
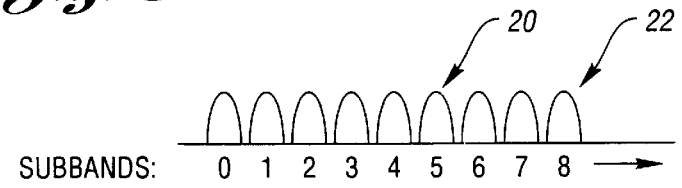
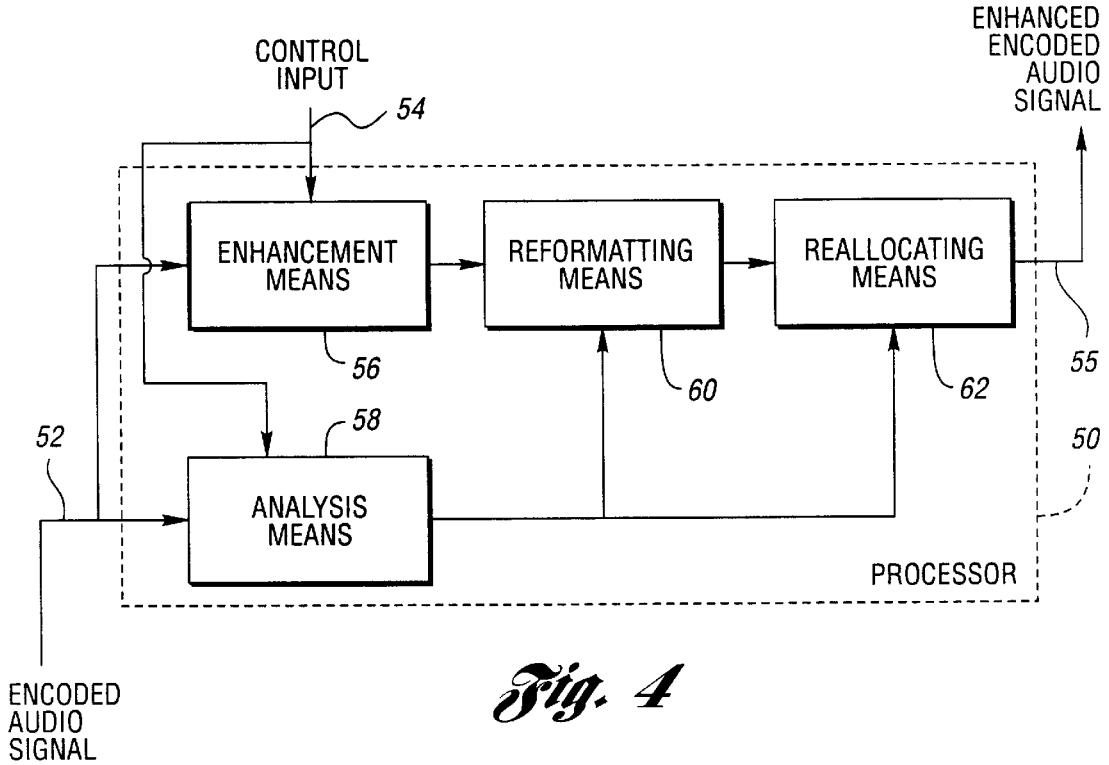
Fig. 4
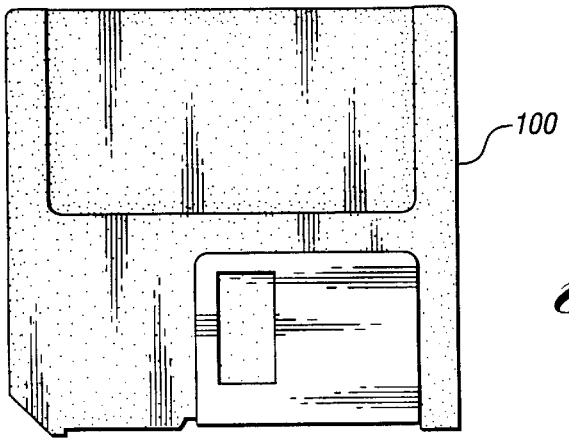
Fig. 5

METHOD, SYSTEM AND PRODUCT FOR HARMONIC ENHANCEMENT OF ENCODED AUDIO SIGNALS

CROSS-REFERENCE TO RELATED APPLICATIONS

This application is related to U.S. patent application Ser. Nos. 08/771,790 entitled "Method, System And Product For Lossless Encoding Of Digital Audio Data"; U.S. Ser. No. 08/771,462 entitled "Method, System And Product For Modifying The Dynamic Range Of Encoded Audio Signals"; U.S. Ser. No. 08/771,792 entitled "Method, System And Product For Modifying Transmission And Playback Of Encoded Audio Data"; U.S. Ser. No. 08/769,911 entitled "Method, System And Product For Multiband Compression Of Encoded Audio Signals"; U.S. Ser. No. 08/777,724 entitled "Method, System And Product For Mixing Of Encoded Audio Signals"; U.S. Ser. No. 08/769,732 entitled "Method, System And Product For Using Encoded Audio Signals In A Speech Recognition System"; U.S. Ser. No. 08/772,591 entitled "Method, System And Product For Synthesizing Sound Using Encoded Audio Signals"; U.S. Ser. No. 08/769,731 entitled "Method, System And Product For Concatenation Of Sound And Voice Files Using Encoded Audio Data"; and U.S. Ser. No. 08/771,469 entitled "Graphic Interface System And Product For Editing Encoded Audio Data", all of which were filed on the same date and assigned to the same assignee as the present application.

TECHNICAL FIELD

The present invention relates to a method, system and product for adding artificial harmonics at octave intervals to encoded audio signals

BACKGROUND ART

To more efficiently transmit digital audio data on low bandwidth data networks, or to store larger amounts of digital audio data in a small data space, various data compression or encoding systems and techniques have been developed. Many such encoded audio systems use as a main element in data reduction the concept of not transmitting, or otherwise not storing portions of the audio that might not be perceived by an end user. As a result, such systems are referred to as perceptually encoded or "lossy" audio systems.

However, as a result of such data elimination, perceptually encoded audio systems are not considered "audiophile" quality, and suffer from processing limitations. To overcome such deficiencies, a method, system and product have been developed to encode digital audio signals in a loss-less fashion, which is more properly referred to as "component audio" rather than perceptual encoding, since all portions or components of the digital audio signal are retained. Such a method, system and product are described in detail in U.S. patent application Ser. No. 08/771,790 entitled "Method, System And Product For Lossless Encoding Of Digital Audio Data", which was filed on the same date and assigned to the same assignee as the present application, and is hereby incorporated by reference.

Many broadcasters use analog or non-perceptual modes of enhancing and processing audio for clarity of broadcast or recording. Such conventional methods add even numbered harmonics in the analog domain or in a digital signal processor implementation thereof. Unfortunately, such methods also add odd harmonics (such as #3, #5, #7, etc.) that are discordant or audible as distortion, since distortion is the method used to implement such methods. In the digital perceptual signal path, however, no such processing exists.

Thus, there exists a need for a method, system and product for harmonic enhancement of encoded audio signals, particularly perceptually encoded audio signals. Such a method, system and product would add synthetic harmonics at octave intervals to perceptually encoded audio signals, thereby adding clarity to the signals and/or compensating for low audio bandwidth.

SUMMARY OF THE INVENTION

Accordingly, it is the principle object of the present invention to provide a method, system and product for harmonic enhancement of encoded audio signals.

According to the present invention, then, a method is provided for harmonic enhancement of an encoded audio signal. The method comprises receiving the encoded audio signal, the encoded audio signal having a plurality of frequency subbands, selecting a first one of the plurality of subbands having a data sample associated therewith, and generating a frequency doubled copy of the data sample associated with the first one of the plurality of subbands. The method further comprises generating a new data sample for a second one of the plurality of subbands using the frequency doubled copied data sample, the second one of the plurality of subbands having a frequency greater than the first one of the plurality of subbands by one octave, and modifying the encoded audio signal to create an enhanced encoded audio signal having the new data sample associated with the second one of the plurality of subbands.

A system for harmonic enhancement of an encoded audio signal is also provided. The system comprises a receiver for receiving the encoded audio signal, the encoded audio signal having a plurality of frequency subbands, and means for selecting a first one of the plurality of subbands having a data sample associated therewith. The system further comprises control logic operative to generate a frequency doubled copy of the data sample associated with the first one of the plurality of subbands, generate a new data sample for a second one of the plurality of subbands using the frequency doubled copied data sample, the second one of the plurality of subbands having a frequency greater than the first one of the plurality of subbands by one octave, and modify the encoded audio signal to create an enhanced encoded audio signal having the new data sample associated with the second one of the plurality of subbands.

A product for harmonic enhancement of an encoded audio signal is also provided. The product comprises a storage medium having computer readable programmed instructions recorded thereon The instructions are operative to generate a frequency doubled copy of a data sample associated with a first one of a plurality of subbands associated with the encoded audio signal, generate a new data sample for a second one of the plurality of subbands using the frequency doubled copied data sample, the second one of the plurality of subbands having a frequency greater than the first one of the plurality of subbands by one octave, and modify the encoded audio signal to create an enhanced encoded audio signal having the new data sample associated with the second one of the plurality of subbands.

These and other objects, features and advantages will be readily apparent upon consideration of the following detailed description in conjunction with the accompanying drawings.

BRIEF DESCRIPTION OF THE DRAWINGS

FIG. 3 is a graphic representations of original encoded audio data and an exemplary modification thereto according to the present invention;

FIG. 4 is a simplified block diagram of the system of the present invention; and FIG. 5 is an exemplary storage medium for use with the product of the present invention.

BEST MODE FOR CARRYING OUT THE INVENTION

Figure 1:
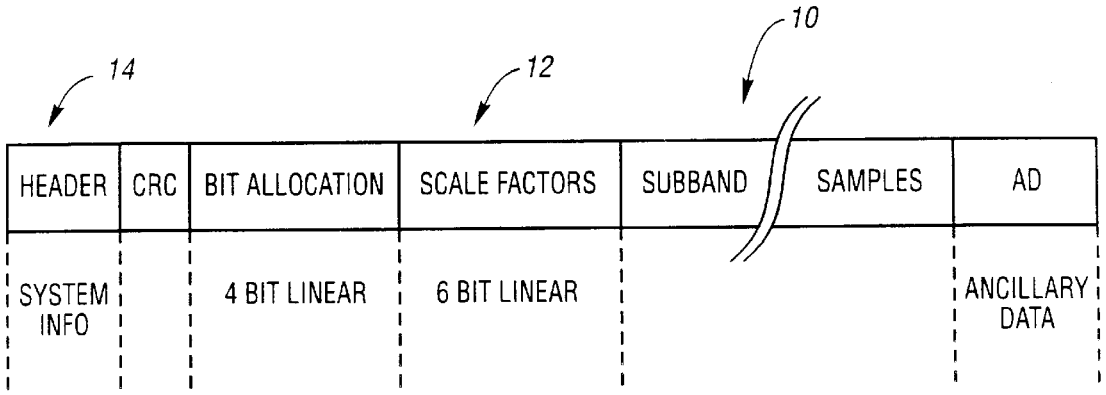
Fig. 1 (PRIOR ART)
FIG. 1 is an exemplary encoding format for an audio frame according to prior art perceptually encoded audio systems.

Referring now to FIGS. 1–5, the preferred embodiment of the present invention will now be described. FIG. 1 depicts an exemplary encoding format for an audio frame according to prior art perceptually encoded audio systems, such as the various layers of the Motion Pictures Expert Group (MPEG), Musicam, or others. Examples of such systems are described in detail in a paper by K. Brandenburg et al. entitled "ISO-MPEG-1 Audio: A Generic Standard For Coding High-Quality Digital Audio", Audio Engineering Society, 92nd Convention, Vienna, Austria, March 1992, which is hereby incorporated by reference.

In that regard, it should be noted that the present invention can be applied to subband data encoded as either time versus amplitude (low bit resolution audio bands as in MPEG audio layers 1 or 2, and Musicam) or as frequency elements representing frequency, phase and amplitude data (resulting from Fourier transforms or inverse modified discrete cosine spectral analysis as in MPEG audio layer 3, Dolby AC3 and similar means of spectral analysis). It should further be noted that the present invention is suitable for use with any system using mono, stereo or multichannel sound including Dolby AC3, 5.1 and 7.1 channel systems.

As seen in FIG. 1, such perceptually encoded digital audio includes multiple frequency subband data samples (10), as well as 6 bit dynamic scale factors (12) (per subband) representing an available dynamic range of approximately 120 decibels (dB) given a resolution of 2 dB per scale factor. The bandwidth of each subband is ⅓ octave. Such perceptually encoded digital audio still further includes a header (14) having information pertaining to sync words and other system information such as data formats, audio frame sample rate, channels, etc.

To greatly increase the available dynamic range and/or the resolution thereof, one or more bits may be added to the dynamic scale factors (12). For example, by using 8 bit dynamic scale factors, the dynamic range is doubled to 256 dB and given an improved 1 dB per scale factor resolution. Alternatively, such 8 bit dynamic scale factors, with a given resolution of 0.5 dB per scale factor, will provide a dynamic range of 128 dB. In either case, the accuracy of storage is increased or maintained well beyond what is needed for dynamic range, while the side-effects of low resolution dynamic scaling are reduced.

Figure 2:
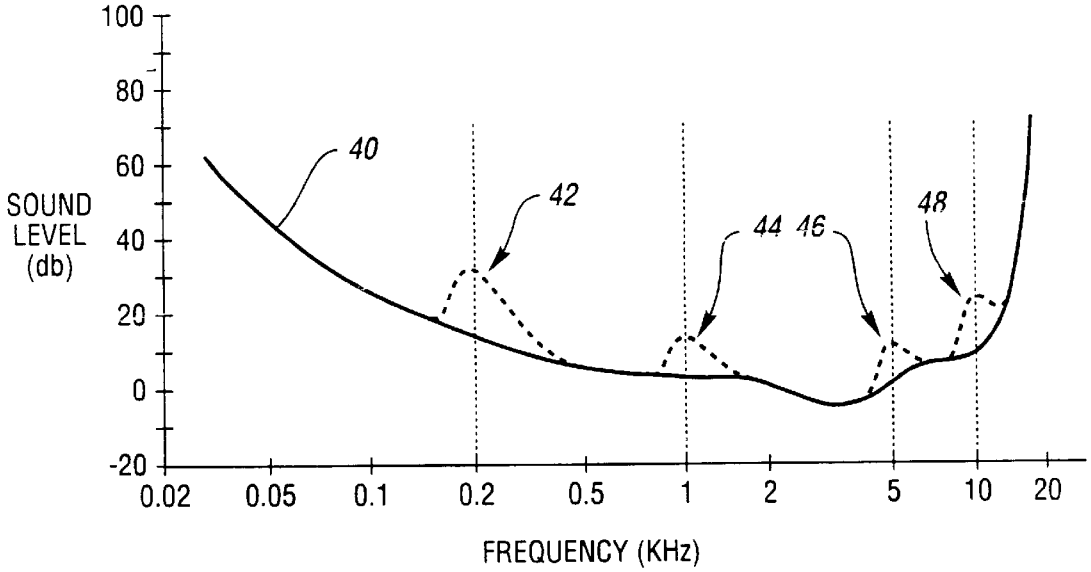
Fig. 2 (PRIOR ART)
FIG. 2 is a psychoacoustic model of a human ear including exemplary masking effects for use with the present invention.

As previously discussed, perceptually encoded audio systems eliminate portions of the audio that might not be perceived by an end user. This is accomplished using well known psychoacoustic modeling of the human ear. Referring now to FIG. 2, such a psychoacoustic model including exemplary masking effects is shown. As seen therein, at a given frequency (in kHz), sound levels (in dB) below the base line curve (40) are inaudible. Using this information, prior art perceptually encoded audio systems eliminate data samples in those frequency subbands where the sound level is likely inaudible.

As also seen therein, short band noise centered at various frequencies (42, 44, 46, 48) modifies the base line curve (40) to create what are known as masking effects. That is, such noise (42, 44, 46, 48) raises the level of sound required around such frequencies before that sound will be audible to the human ear. Using this information, prior art perceptually encoded audio systems further eliminate data samples in those frequency subbands where the sound level is likely inaudible due to such masking effects.

Alternatively, using a loss-less component audio encoding scheme, such masked audio may be retained. Once again, such a loss-less component audio encoding scheme is described in detail in U.S. patent application Ser. No. 08/771,790 entitled "Method, System And Product For Lossless Encoding Of Digital Audio Data", which was filed on the same date and assigned to the same assignee as the present application, and has been incorporated herein by reference.

In either case, if no information is present to be encoded into a subband, the subband does not need to be transmitted. Moreover, if the subband data is well below the level of audibility (not including masking effects), as shown by base line curve (40) of FIG. 2, the particular subband need not be encoded.

Referring now to FIG. 3, a graphic representation of original encoded audio data and an exemplary modification thereto according to the present invention is shown. In that regard, FIG. 3 depicts certain frequency subbands encoded for an audio signal according to a 32 subband perceptual encoding audio system, such as MPEG layer 2.

To enhance such an encoded audio signal, the present invention adds thereto synthetic harmonics to add clarity to the perceptually encoded audio signal or compensate for low audio bandwidth. In that regard, the present invention adds synthetic harmonics at only the octave intervals (e.g. harmonics #2, #4, #8, #16, etc.), thereby producing a pure type of enhancement that approximates the type of distortion that the Human ear naturally produces. In such a fashion, the present invention can produce high enhancement levels without adding the enharmonic elements, producing a much cleaner sounding process.

More specifically, referring still to FIG. 3, the present invention operates by selecting sample data of any subband of the encoded audio signal, and copying the characteristics of the sample including doubling it in frequency. The particular subbands selected may be all subbands or any subset thereof, such as a limited range. Of course, those of ordinary skill in the art will recognize that this is most easily accomplished in the frequency domain (e.g., MPEG layer 3, Dolby AC3, etc.).

Next, the present invention places this new information in a subband three subbands higher than the original subband (assuming standard ⅓ octave subbands) and modify the associated scaling, data packing, and masking information for the data transmission. As seen in FIG. 3, sample data (20) copied from subband #5 is added to existing sample data (22) in subband #8. In that regard, if no existing sample data (22) was present in subband #8, the sample data (20) copied from subband #5 would simply be inserted in subband #8. Moreover, if the sample data (20) copied from subband #5 is significantly lower (scale factor) than sample data (22) present in subband #8, then sample data (20) copied from subband #5 is not added to sample data (22) present in subband #8.

Moreover, as stated above, the present invention would also determine if the new sample data in subband #8 (however it resulted) was sufficient to exceed the masking effects associated with the signal. If so, then the encoded audio signal would be reformatted so that an appropriate scale factor is assigned for the new sample data in subband #8, and so that bit allocation and/or packing may be altered accordingly. Of course, for component audio encoded as described generally above and more specifically in U.S. patent application Ser. No.08/771,790 which was previously incorporated by reference, such operations need not be undertaken for the reasons set forth therein.

Referring now to FIG. 4, a simplified block diagram of the system of the present invention is shown. As seen therein, the system preferably comprises an appropriately programmed processor (50) for Digital Signal Processing (DSP). Processor (50) acts as a receiver for receiving an encoded audio signal (52) (which may be a stored sound file/asset) having a plurality of frequency subbands associated therewith. While described herein as perceptually encoded, as previously stated, an encoded audio signal (52) may also be a component audio signal.

Once programmed, processor (50) provides control logic for performing various functions of the present invention. In that regard, processor (50) also receives control input (54) for selecting a first one of the plurality of subbands having a data sample associated therewith, as well as other purposes, such as controlling the amount of enhancement added to the encoded signal.

Still referring to FIG. 4, the control logic of processor (50) is operative to generate a frequency doubled copy of the data sample associated with the first one of the plurality of subbands. Using the frequency doubled copied data sample, the control logic is further operative to generate a new data sample at twice frequency for a second one of the plurality of subbands having a frequency greater than the first one of the plurality of subbands by one octave. The control logic is then operative to modify the encoded audio signal to create an enhanced encoded audio signal (55) having the new data sample associated with the second one of the plurality of subbands.

To generate a new data sample for a second one of the plurality of subbands, the control logic of processor (50) is operative to determine if the second one of the plurality of subbands has an existing data sample associated therewith. If so, the control logic is further operative to add the frequency doubled copied data sample to the existing data sample. If not, the control logic is further operative to set the new data sample for the second one of the plurality of subbands equal to the frequency doubled copied data sample. Once again, if the frequency doubled copied data sample is significantly lower (scale factor) than the data sample present in the subband to which it is to be added, then the frequency doubled copied data sample is not added.

To generate a new data sample for a second one of the plurality of subbands, the control logic is further operative to determine if the new data sample associated with the second one of the plurality of subbands exceeds a masking effect associated with the encoded audio signal, as previously described. Still further, to modify the encoded audio signal, the control logic is operative to reformat bit and scaling information associated with the encoded audio signal, as also previously described. Once again, where the encoded audio signal is component audio, such operations as reformatting need not be undertaken.

As shown in FIG. 4, the control logic of processor (50) may comprise enhancement means (56) for performing the harmonic enhancement functions described above, as well as analysis means (58) for performing the analysis functions described above. In that regard, both enhancement means (56) and analysis means (58) are capable of receiving control input (54). In this example, the control logic of processor (50) further comprises reformatting means (60) and reallocating means (62) for performing the data reformatting and bit reallocating functions also described above.

Referring finally to FIG. 5, an exemplary storage medium for the product of the present invention is shown. In that regard, storage medium (100) is depicted as a conventional floppy disk, although any other type of storage medium may also be used.

Storage medium (100) has recorded thereon computer readable programmed instructions for performing various functions of the present invention. More particularly, storage medium (100) includes instructions operative to generate a frequency doubled copy of a data sample associated with a first one of a plurality of subbands associated with the encoded audio signal, generate a new data sample for a second one of the plurality of subbands using the frequency doubled copied data sample, the second one of the plurality of subbands having a frequency greater than the first one of the plurality of subbands by one octave, and modify the encoded audio signal to create an enhanced encoded audio signal having the new data sample associated with the second one of the plurality of subbands.

In that regard, to generate a new data sample for a second one of the plurality of subbands, the instructions are operative to determine if the second one of the plurality of subbands has an existing data sample associated therewith, if the second one of the plurality of subbands has an existing data sample associated therewith, add the frequency doubled copied data sample to the existing data sample, and if the second one of the plurality of subbands lacks an existing data sample associated therewith, set the new data sample for the second one of the plurality of subbands equal to the frequency doubled copied data sample. Still further, to generate a new data sample for a second one of the plurality of subbands, the instructions are also operative to determine if the new data sample associated with the second one of the plurality of subbands exceeds a masking effect associated with the encoded audio signal. To modify the encoded audio signal, the instructions may also be operative to reformat bit and scaling information associated with the encoded audio signal.

This invention works on passing data streams or fixed recorded assets and adds very clean sounding enhancement without adding non-octave distortion. In such a fashion, the original program material can be encoded according to widely deployed encoding schemes/systems and remain uncompromised. Moreover, the present invention improves the quality of digital, present and future broadcasting systems, especially those of limited dynamic range and limited data, audio bandwidth, but also any high end systems. This type of processing would also be of importance for production uses.

It should be noted that the present invention can also be adapted for use in conventional audio systems and deployed in analog, digital, etc. for any passing or static, wideband or narrowband signal. The present invention also increases the intelligibility of low audio bandwidth signals by accentuating the lower elements of signals such as human speech, etc.

In that same regard, it should also be noted that the present invention is suitable for use in any type of DSP application including computer systems, hearing aids, transmission across networks including cellular, wireless and cable telephony, internet, cable television, satellites, audio/video post-production, etc. It should still further be noted that the present invention can be used in conjunction with the inventions disclosed in U.S. patent application Ser. Nos. 08/771,790 entitled "Method, System And Product For Lossless Encoding Of Digital Audio Data"; U.S. Ser. No. 08/771,462 entitled "Method, System And Product For Modifying The Dynamic Range Of Encoded Audio Signals"; U.S. Ser. No. 08/771,792 entitled "Method, System And Product For Modifying Transmission And Playback Of Encoded Audio Data"; U.S. Ser. No. 08/769,911 entitled "Method, System And Product For Multiband Compression Of Encoded Audio Signals"; U.S. Ser. No. 08/777,724 entitled "Method, System And Product For Mixing Of Encoded Audio Signals"; U.S. Ser. No. 08/769,732 entitled "Method, System And Product For Using Encoded Audio Signals In A Speech Recognition System"; U.S. Ser. No. 08/772,591 entitled "Method, System And Product For Synthesizing Sound Using Encoded Audio Signals"; U.S. Ser. No. 08/769,731 entitled "Method, System And Product For Concatenation Of Sound And Voice Files Using Encoded Audio Data"; and U.S. Ser. No. 08/771,469 entitled "Graphic Interface System And Product For Editing Encoded Audio Data", all of which were filed on the same date and assigned to the same assignee as the present application, and which are hereby incorporated by reference.

As is readily apparent from the foregoing description, then, the present invention provides a method, system and product for harmonic enhancement of encoded audio signals, particularly perceptually encoded audio signals. More particularly, the present invention adds synthetic harmonics at octave intervals to perceptually encoded audio signals, thereby adding clarity to the signals and/or compensating for low audio bandwidth.

It is to be understood that the present invention has been described above in an illustrative manner and that the terminology which has been used is intended to be in the nature of words of description rather than of limitation. As previously stated, many modifications and variations of the present invention are possible in light of the above teachings. Therefore, it is also to be understood that, within the scope of the following claims, the invention may be practiced otherwise than as specifically described herein.

What is claimed is:

1. A method for harmonic enhancement of an encoded audio signal, the method comprising:

receiving the encoded audio signal, the encoded audio signal having a plurality of frequency subbands;

selecting a first one of the plurality of subbands having a data sample associated therewith;

generating a frequency doubled copy of the data sample associated with the first one of the plurality of subbands;

generating a new data sample for a second one of the plurality of subbands using the frequency doubled copied data sample, the second one of the plurality of subbands having a frequency greater than the first one of the plurality of subbands by one octave; and modifying the encoded audio signal to create an enhanced encoded audio signal having the new data sample associated with the second one of the plurality of subbands.

2. The method of claim 1 wherein the encoded audio signal comprises a perceptually encoded audio signal.

3. The method of claim 1 wherein generating a new data sample for a second one of the plurality of subbands comprises:

determining if the second one of the plurality of subbands has an existing data sample associated therewith;

if the second one of the plurality of subbands has an existing data sample associated therewith, adding the frequency doubled copied data sample to the existing data sample; and if the second one of the plurality of subbands lacks an existing data sample associated therewith, setting the new data sample for the second one of the plurality of subbands equal to the frequency doubled copied data sample.

4. The method of claim 3 further comprising determining if the new data sample associated with the second one of the plurality of subbands exceeds a masking effect associated with the encoded audio signal.

5. The method of claim 4 wherein modifying the encoded audio signal includes reformatting bit and scaling information associated with the encoded audio signal.

6. A system for harmonic enhancement of an encoded audio signal, the system comprising:

a receiver for receiving the encoded audio signal, the encoded audio signal having a plurality of frequency subbands;

means for selecting a first one of the plurality of subbands having a data sample associated therewith; and control logic operative to generate a frequency doubled copy of the data sample associated with the first one of the plurality of subbands, generate a new data sample for a second one of the plurality of subbands using the frequency doubled copied data sample, the second one of the plurality of subbands having a frequency greater than the first one of the plurality of subbands by one octave, and modify the encoded audio signal to create an enhanced encoded audio signal having the new data sample associated with the second one of the plurality of subbands.

7. The system of claim 6 wherein the encoded audio signal comprises a perceptually encoded audio signal.

8. The system of claim 6 wherein, to generate a new data sample for a second one of the plurality of subbands, the control logic is operative to determine if the second one of the plurality of subbands has an existing data sample associated therewith, if the second one of the plurality of subbands has an existing data sample associated therewith, add the frequency doubled copied data sample to the existing data sample, and if the second one of the plurality of subbands lacks an existing data sample associated therewith, set the new data sample for the second one of the plurality of subbands equal to the frequency doubled copied data sample.

9. The system of claim 8 wherein, to generate a new data sample for a second one of the plurality of subbands, the control logic is further operative to determine if the new data sample associated with the second one of the plurality of subbands exceeds a masking effect associated with the encoded audio signal.

10. The system of claim 9 wherein, to modify the encoded audio signal, the control logic is operative to reformat bit and scaling information associated with the encoded audio signal.

11. A product for harmonic enhancement of an encoded audio signal, the product comprising a storage medium having computer readable programmed instructions recorded thereon, the instructions operative to generate a frequency doubled copy of a data sample associated with a first one of a plurality of subbands associated with the encoded audio signal, generate a new data sample for a second one of the plurality of subbands using the frequency doubled copied data sample, the second one of the plurality of subbands having a frequency greater than the first one of the plurality of subbands by one octave, and modify the encoded audio signal to create an enhanced encoded audio signal having the new data sample associated with the second one of the plurality of subbands.

12. The product of claim 11 wherein the encoded audio signal comprises a perceptually encoded audio signal.

13. The product of claim 11 wherein, to generate a new data sample for a second one of the plurality of subbands, the instructions are operative to determine if the second one of the plurality of subbands has an existing data sample associated therewith, if the second one of the plurality of subbands has an existing data sample associated therewith, add the frequency doubled copied data sample to the existing data sample, and if the second one of the plurality of subbands lacks an existing data sample associated therewith, set the new data sample for the second one of the plurality of subbands equal to the frequency doubled copied data sample.

14. The product of claim 13 wherein, to generate a new data sample for a second one of the plurality of subbands, the instructions are further operative to determine if the new data sample associated with the second one of the plurality of subbands exceeds a masking effect associated with the encoded audio signal.

15. The product of claim 14 wherein, to modify the encoded audio signal, the instructions are operative to reformat bit and scaling information associated with the encoded audio signal.

* * * * *